US009453275B2

(12) United States Patent
Bergen et al.

(10) Patent No.: US 9,453,275 B2
(45) Date of Patent: Sep. 27, 2016

(54) DEVICE FOR HOT DIP COATING METAL STRIP INCLUDING A SNOUT AND AN EXTENSION PIECE

(71) Applicant: ThyssenKrupp Steel Europe AG, Duisburg (DE)

(72) Inventors: Jegor Bergen, Rheinberg (DE); Frank Spelleken, Dinslaken (DE); Michael Peters, Kleve (DE); Manuele Ruthenberg, Dortmund (DE); Friedhelm Macherey, Alpen (DE); Florian Spelz, Oberhausen (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 0 days.

(21) Appl. No.: 14/765,691

(22) PCT Filed: Feb. 4, 2014

(86) PCT No.: PCT/EP2014/052148

§ 371 (c)(1),
(2) Date: Aug. 4, 2015

(87) PCT Pub. No.: WO2014/122128

PCT Pub. Date: Aug. 14, 2014

(65) Prior Publication Data

US 2015/0368776 A1 Dec. 24, 2015

(30) Foreign Application Priority Data

Feb. 5, 2013 (DE) ..... 10 2013 101 131

(51) Int. Cl.
*C23C 2/00* (2006.01)
*C23C 2/12* (2006.01)

(Continued)

(52) U.S. Cl.
CPC ..... *C23C 2/003* (2013.01); *C23C 2/06* (2013.01); *C23C 2/12* (2013.01); *C23C 2/38* (2013.01);

(Continued)

(58) Field of Classification Search
CPC ..... C23C 2/38; C23C 2/20; C23C 2/06; C23C 2/00; C23C 2/40; C23C 2/12; B05C 3/125
USPC ..... 427/431, 329; 118/DIG. 19; 14/431, 329
See application file for complete search history.

(56) References Cited

U.S. PATENT DOCUMENTS 2,166,250 A * 7/1939 Herman ..... C23C 2/06 118/422
3,010,844 A * 11/1961 Klein ..... C23C 2/02 118/429

(Continued)

FOREIGN PATENT DOCUMENTS

EP 0650534 B1 5/1995

*Primary Examiner* — Karl Kurple
(74) *Attorney, Agent, or Firm* — The Webb Law Firm

(57) ABSTRACT

An apparatus for hot dip coating metal strip is disclosed having a dip bath vessel (4), a snout (6) which opens into the dip bath vessel for introducing a metal strip (1) which is heated in a continuous furnace into the dip bath, and a deflecting roller (7) which is arranged in the dip bath vessel for deflecting the metal strip (1) which enters into the dip bath in a direction which points out of the dip bath. The snout (6) is provided with a shaft-shaped snout extension piece (6.1) for increasing the snout dipping depth, the internal width of the snout extension piece (6.1) tapering toward its outlet opening (6.15) at least over a part length of said snout extension piece (6.1). As a result, an increase or maximization of the eddy flow in the molten metal at or close to the metal strip (1) and therefore improved homogenization of the molten metal in the region of the strip is achieved, as a result of which slag-induced surface defects on the surface of the coated metal strip (1) can be avoided.

14 Claims, 7 Drawing Sheets

(51) Int. Cl.

| | |
|---|---|
| ***C23C 2/06*** | (2006.01) |
| ***C23C 2/38*** | (2006.01) |
| ***C23C 2/40*** | (2006.01) |
| *B05C 3/12* | (2006.01) |
| *B05D 1/18* | (2006.01) |
| *B05C 11/06* | (2006.01) |

(52) U.S. Cl.
CPC ..... *C23C 2/40* (2013.01); *B05C 3/125* (2013.01); *B05C 11/06* (2013.01); *B05D 1/18* (2013.01); *Y10S 118/19* (2013.01)

(56) References Cited

U.S. PATENT DOCUMENTS 3,287,158 A 11/1966 Whitfield
3,592,160 A * 7/1971 Schwieterman ..... C23C 2/36 118/419
3,667,425 A * 6/1972 Bozeman ..... C23C 2/20 118/63
3,932,683 A * 1/1976 Robins ..... C23C 2/20 118/63
4,082,868 A * 4/1978 Schnedler ..... B05C 9/02 118/419
4,123,291 A * 10/1978 Arnold ..... C23C 2/38 148/264
4,123,292 A * 10/1978 Gibson ..... C23C 2/38 148/287
4,177,303 A 12/1979 Clipston et al.
4,183,983 A * 1/1980 Cook ..... C23C 2/02 118/65
4,478,892 A * 10/1984 Amberson ..... C23C 2/02 118/419
4,752,508 A * 6/1988 Sippola ..... C23C 2/14 427/431
5,284,680 A * 2/1994 Bilimoria ..... C21D 9/52 427/307
5,639,419 A * 6/1997 Morando ..... B01F 3/04248 118/422
6,426,122 B1 * 7/2002 Ishii ..... C23C 2/003 427/431
2004/0028832 A1 * 2/2004 Dauchelle ..... C23C 2/00 427/431
2004/0052958 A1 * 3/2004 Dauchelle ..... C23C 2/00 427/431
2004/0052959 A1 * 3/2004 Dauchelle ..... C23C 2/00 427/431
2005/0233088 A1 * 10/2005 Trakowski ..... C23C 2/02 427/433
2007/0003778 A1 * 1/2007 McDevitt ..... C23C 2/02 428/553
2009/0098294 A1 * 4/2009 Malas ..... C23C 2/003 427/273
2012/0180721 A1 * 7/2012 Hoshino ..... C21D 9/56 118/708
2013/0160647 A1 * 6/2013 Yamauchi ..... B01D 45/06 95/267
2014/0037856 A1 * 2/2014 Moon ..... C23C 2/12 427/436
2015/0368777 A1 * 12/2015 Bergen ..... C23C 2/40 428/653
2015/0376758 A1 * 12/2015 Bergen ..... C23C 2/40 148/508
2016/0076127 A1 * 3/2016 Moon ..... C23C 2/16 118/63
2016/0102393 A1 * 4/2016 Schaffrath ..... B05C 3/125 118/713

* cited by examiner

DEVICE FOR HOT DIP COATING METAL STRIP INCLUDING A SNOUT AND AN EXTENSION PIECE

CROSS-REFERENCE TO RELATED APPLICATIONS

This application is the United States national phase of International Application No. PCT/EP2014/052148 filed Feb. 4, 2014, and claims priority to German Patent Application No. 10 2013 101 131.4 filed Feb. 5, 2013, the disclosures of which are hereby incorporated in their entirety by reference.

BACKGROUND OF THE INVENTION

1. Field of the Invention

The invention relates to an apparatus for hot dip coating metal strip, preferably steel strip, having a dip bath vessel, a snout which opens into the dip bath vessel for introducing a metal strip which is heated in a continuous furnace into the dip bath, and a deflecting roller which is arranged in the dip bath vessel for deflecting the metal strip which enters into the dip bath in a direction which points out of the dip bath.

2. Description of Related Art

An apparatus of this type is known, for example, from EP 0 650 534 B1. Apparatuses or systems of this type are also called hot dip coating systems. They are distinguished by a continuous method of operation.

In hot dip coating systems from the prior art, oxides and slag which can lead to defects in the coating of the metal strip accumulate on the surface of the molten metal within the snout. During the dipping of the strip, the slag is carried along by the strip and, for example, locations with poor adhesion are produced on account of faults in the alloy layer and slag inclusions and imperfections (uncoated locations) in the coating.

SUMMARY OF THE INVENTION

The present invention is based on the object of improving an apparatus of the type mentioned at the outset in such a way that slag-induced surface defects on the surface of the coated metal strip are avoided.

The apparatus according to the invention comprises a dip bath vessel, a snout which opens therein for introducing a metal strip which is heated in a continuous furnace into the dip bath, and a deflecting roller which is arranged in the dip bath vessel for deflecting the metal strip which enters into the dip bath from the snout in a direction which points out of the dip bath. According to the invention, the apparatus is distinguished by the fact that the snout is provided with a shaft-shaped snout extension piece for increasing the snout dipping depth, the internal width of the snout extension piece tapering toward its outlet opening at least over a part length of said snout extension piece.

The snout extension piece according to the invention can be a separately manufactured component which is attached to the lower end of the snout while leaving at least one feed opening. However, it can also be configured in one piece with the snout or can be connected in a fluid-tight manner to the lower end of the snout.

The internal width of the shaft-shaped snout extension piece corresponds substantially to the clear internal height, preferably the clear vertical internal height, or the internal diameter of the snout extension piece. The internal width of the snout extension piece is measured transversely, for example perpendicularly, with respect to the plane of the metal strip section which runs through the snout extension piece.

During movement of the metal strip through the snout, a drag action on the molten metal emanates from the strip, by way of which drag action a flow of the molten metal parallel to the strip running direction is generated in the direction of the deflecting roller at the strip and in its vicinity. In conventional apparatuses for hot dip coating metal strip, said flow is not influenced, or is not influenced significantly, by the snout which has a substantially constant internal width or clear internal height there. In the apparatus according to the invention, in contrast, the eddy flow which occurs at the metal strip is increased by the extension of the snout or the increase in the dipping depth of the snout. At the same time, influences from the molten metal in the dip bath vessel on the molten metal in the snout are avoided as a result. In particular, the flow of the molten metal within the snout is intensified on account of the Bernoulli effect as a result of the tapering of the internal width or clear internal height of the snout extension piece toward its outlet opening. The flow which is intensified in this way within the snout is distinguished by relatively high turbulence which causes an increased flow speed at the dip bath surface level and improved mixing/homogenization of the molten metal and therefore prevents slag formation or slag accumulation at the dip bath surface level within the snout as far as possible. In this way, slag-induced surface defects on the surface of the coated metal strip can be avoided. Circulation of the molten metal within the snout, in particular at the dip bath surface in the snout, is brought about by way of the snout extension according to the invention. Any oxide layers which are possibly present are torn open as a result and cannot join together.

One advantageous embodiment of the apparatus according to the invention provides that the internal width or clear internal height of the snout extension piece tapers constantly toward its outlet opening at least over a part length of said snout extension piece. As a result, considerable intensifying of the flow can be achieved in a reliable way even in the case of a relatively short extension of the dipped snout section, and slag formation or slag accumulation at the dip bath surface level in the snout can therefore be avoided.

As an alternative or in addition, the internal width or clear internal height of the snout extension piece can also taper toward its outlet opening at least over a part length of said snout extension piece in a stepped manner in the form of one or more internal width steps (internal height steps) and/or in the form of snout wall sections which are angled away differently with respect to one another. In this way, considerable intensifying of the flow can also be achieved in a reliable way and slag formation or slag accumulation at the dip bath surface level in the snout can be avoided. The realization of the tapered portion/portions of the snout by way of one or more internal width steps and/or snout wall sections which are angled away differently with respect to one another is favorable in terms of manufacturing technology and makes it possible to configure special flow profiles in the snout.

In order to achieve sufficient eddy formation or homogenization of the molten metal in the snout, one further preferred embodiment of the apparatus according to the invention provides that the outlet opening or narrowest point of the snout extension piece has a clear internal width of at most 120 mm, preferably of at most 100 mm.

Tests by the inventors have shown that a minimum spacing should be maintained between the outlet opening of the extended snout and the deflecting roller (what is known as a pot roller), since otherwise a back pressure can be set between the snout and the pot roller, which back pressure impairs the flow at the outlet opening of the snout or the snout tapered portion, as a result of which sufficient eddy formation in the snout is possibly impeded. A further preferred embodiment of the apparatus according to the invention therefore provides that the snout extension piece ends at a spacing in the range from 100 mm to 400 mm, preferably from 100 mm to 300 mm, with respect to the circumferential face of the deflecting roller.

The length of the snout extension piece should be dimensioned in such a way that the snout dipping depth is at least 400 mm during the hot dip coating of the metal strip. The length of the snout extension piece is preferably dimensioned in such a way that the snout dipping depth is at least 500 mm, particularly preferably at least 600 mm, during the hot dip coating of the metal strip.

A further advantageous embodiment of the apparatus according to the invention is distinguished by the fact that the snout extension piece has a connector section, into which the lower end of the snout protrudes, the connector section and the snout defining at least one feed channel for the separate addition of coating material or at least one alloying additive into the snout and/or into the snout extension piece. This embodiment makes it possible to provide regions with different molten metal compositions, in order to set defined desired alloy layer properties. By way of the addition of a defined coating or alloying material directly into the snout which acts as a sluice, it is possible to decouple the molten metal composition in the sluice (snout) from the molten metal composition in the remaining part of the dip bath vessel. It is thus possible, for example, to operate the dip bath vessel with a substantially pure aluminum melt and to enrich the molten metal in the sluice (snout) with silicon, with the result that a relatively thin alloy layer is first of all obtained on the metal strip to be coated. The metal strip which is subsequently coated with pure aluminum as top coating is then sufficiently ductile as a result of the thin alloy layer, in order for it to be possible to realize desired forming processes. On account of the top layer of pure aluminum, however, the product also has excellent anti-corrosion properties.

As a result of the unavoidable discharge of molten metal from the sluice (snout) into the dip bath, an undesired negative pressure can form in the snout and the level of the molten metal in the sluice can drop. In this context, a further advantageous embodiment of the apparatus according to the invention is distinguished by the fact that the snout extension piece is provided with at least one separate channel, through which molten metal can flow out of the dip bath vessel in the direction of the molten metal surface in the snout in the case of negative pressure in the snout or in the case of lowering of the molten metal surface (dip bath surface) in the snout with respect to the molten metal surface (dip bath surface) outside the snout. As a result, subsequent flowing of molten metal out of the dip bath into the upper region of the sluice and therefore a relatively constant level of the molten metal in the sluice are ensured.

To this end, the separate channel or channels can be arranged, for example, on the outer side of the snout extension piece. Their inlet openings should be arranged at a sufficiently deep level in the dip bath. They preferably open at the lower end of the snout extension piece.

Furthermore, it is advantageous with regard to the above-mentioned connector section of the snout extension piece and the separate addition of coating material or an alloying additive if, according to a further embodiment of the apparatus according to the invention, the at least one separate channel has an end section which opens above a bottom of the connector section in a throat region of the latter. By way of said embodiment, it is ensured during the use as intended of the apparatus according to the invention that the bottom of the connector section of the snout extension piece is in principle covered with sufficient molten metal. In particular, a relatively great spacing between the orifice opening (outlet opening) of the separate channel and the inlet opening of the snout extension piece can be achieved by way of said embodiment. A relatively great spacing of the outlet opening of the separate channel with respect to the inlet opening of the snout extension piece is expedient with regard to the separate addition of coating material or an alloying additive into the sluice which is defined by the snout, in order that the molten metal which subsequently flows out of the dip bath vessel via the separate channel into the upper region of the sluice can be mixed as homogeneously as possible with the coating material or alloying additive which is added separately into the sluice, and therefore correspondingly homogeneous coating of the metal strip is achieved.

BRIEF DESCRIPTION OF THE DRAWINGS

In the following text, the invention will be explained in greater detail using a drawing which illustrates a plurality of exemplary embodiments and in which, diagrammatically.

DESCRIPTION OF THE INVENTION

Figure 3:
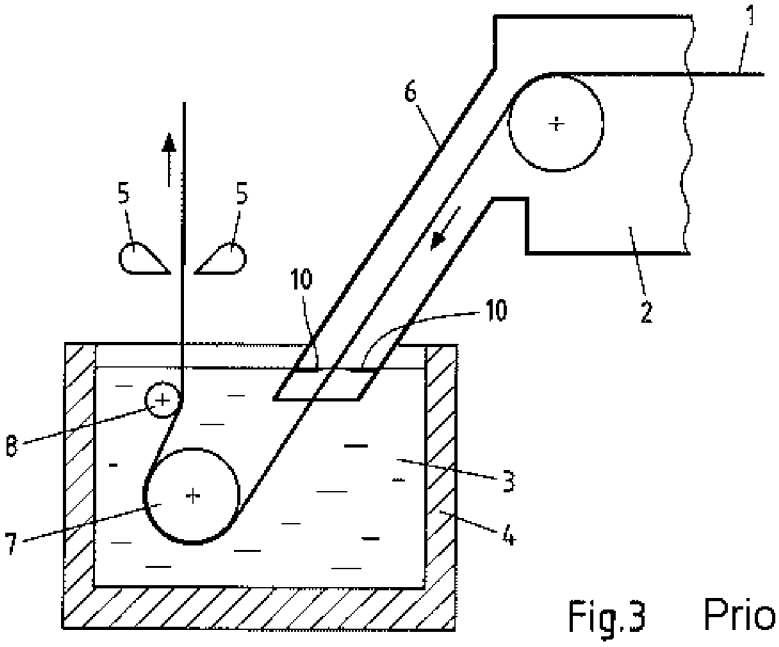
Fig.3 Prior art
FIG. 3 shows an apparatus for hot dip coating metal strip from the prior art, in a vertical sectional view.

FIG. 3 outlines a section of a conventional system for hot dip coating metal strip, in particular steel strip. The metal strip 1 is protected against corrosion by way of the hot dip coating. To this end, the metal strip 1 is first of all purified and recrystallization annealed in a continuous furnace 2. Subsequently, the strip 1 is hot dip refined, by being guided through a molten metal bath 3. For example, zinc, zinc alloys, aluminum and aluminum alloys are used as coating metal for the strip 1. The dip bath vessel 4 is heated electrically in order to maintain the molten state. During the passage of a steel strip 1 through the dip bath 3, an alloy layer of iron and the coating metal is produced on the strip surface. Above this, the metal layer is formed, the composition of which corresponds to the chemical analysis of the molten metal which is situated in the dip bath vessel 4. The layer thickness of the metal layer which serves as anti-corrosion protection is usually set by means of stripping jets 5.

The continuous furnace 2 typically comprises a directly heated preheater (not shown) and indirectly heated reduction and holding zones (not shown) and following cooling zones. At the end of the cooling zone, the furnace 2 is connected via a sluice (snout) 6 to the dip bath 3. A reducing atmosphere of nitrogen and hydrogen is set in the indirectly heated furnace part and in the cooling zones.

The steel strip 1 is recrystallization annealed in the furnace 2, in order that the steel material which is cold work hardened during rolling obtains the required technological properties after passing through the furnace. In addition, a reduction of any iron oxides which are possibly present takes place as a result of the hydrogen component in the furnace atmosphere. In the following cooling zones, the strip 1 is cooled and enters into the dip bath 3 at a temperature which corresponds to the latter. A deflecting roller 7 which is arranged in the dip bath brings about the deflection of the steel strip 1 which enters into the dip bath from the snout 6 in a preferably vertical direction. At least one stabilizing roller 8 and optionally a pressure roller (pass line roller) 9 ensure a flat, oscillation-free passage of the strip 1 through the wide flat snouts 5 of the jet stripping apparatus which are arranged above the dip bath. During the exit from the dip bath 3, the strip 1 carries a quantity of coating material which is dependent on the strip speed out of the dip bath with it. The resulting layer thickness of the metal coat is considerably higher than the desired layer thickness. The excess coating metal is stripped by means of directed air or gas jets from the flat snouts 5, with the result that the desired metal coat layer thickness remains on the strip 1.

In coating systems from the prior art according to FIG. 3, oxide films or slag 10 accumulate on the surface of the molten metal 3 within the snout 6, which oxide films or slag 10 can lead to defects in the alloy layer or in the coating of the metal strip 1. In order to avoid slag-induced coating defects, the invention proposes to increase the dipping depth of the snout 6 and to taper the inner width of the dipped snout extension piece 6.1 toward its outlet opening at least over a part length of said snout extension piece 6.1. The extension according to the invention of the snout 6 can be realized in different embodiments.

Figure 1:
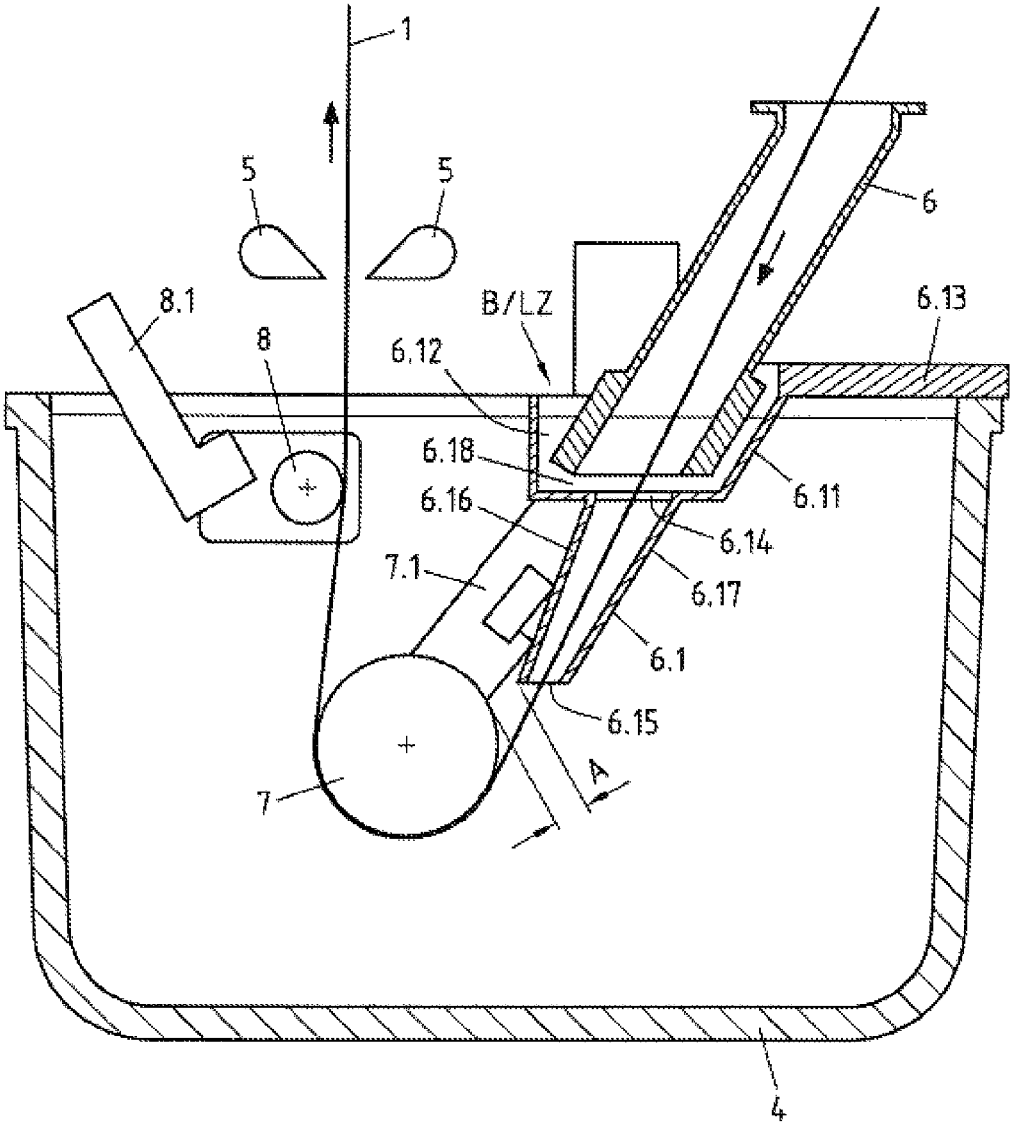
FIG. 1 shows a vertical sectional view of a dip bath vessel having an extended snout, a deflecting roller and a stabilizing roller.
Figure 2:
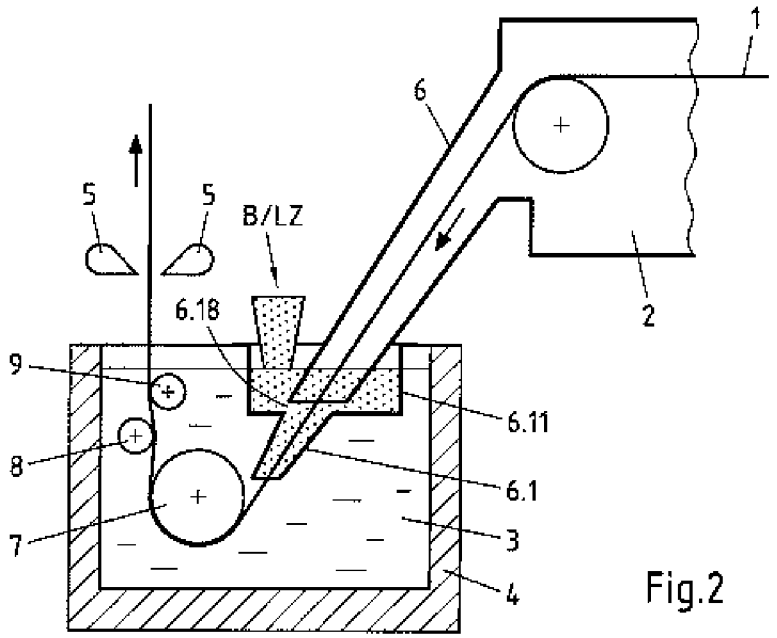
FIG. 2 shows a further exemplary embodiment of an apparatus according to the invention having a dip bath vessel which is shown in a vertically sectioned manner and two stabilizing rollers which are arranged therein.
Figure 4:
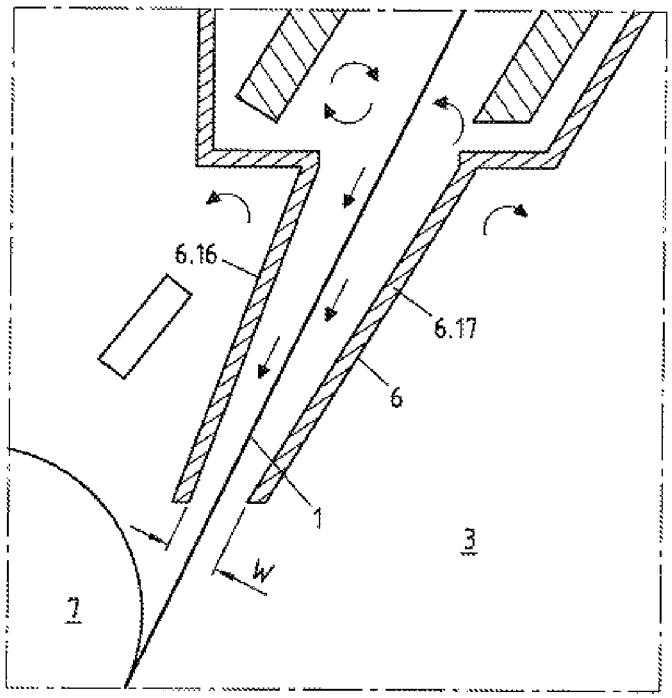
FIG. 4 shows a part region of a dip bath, in which flow conditions in the case of an apparatus according to the invention are illustrated in the region of a snout extension piece.

In the exemplary embodiments which are shown in FIGS. 1, 2 and 4, the snout 6 of a coating system of the generic type which can correspond or corresponds substantially to the coating system according to FIG. 3 is provided with a shaft-shaped snout extension piece 6.1 in order to increase the snout dipping depth. The snout extension piece 6.1 has a connector section 6.11, into which the lower end of the snout 6 protrudes. The connector section 6.11 has a tub-shaped or trough-shaped receiving space 6.12, the circumferential side wall of which is fastened to a carrier 6.13 which is mounted on the upper edge of the dip bath vessel 4. An elongate opening 6.14 is configured in the bottom 6.25 of the connector section 6.11 or receiving space 6.12, through which elongate opening 6.14 the metal strip 1 to be coated runs into the shaft-shaped snout extension piece 6.1. The internal width (clear internal height) W of the snout extension piece 6.1 tapers toward its outlet opening 6.15. The tapering of the internal width results from the fact that those walls 6.16, 6.17 of the snout extension piece 6.1 which face the upper side and underside of the strip 1 converge in the direction of the outlet opening 6.15. In this exemplary embodiment, the internal diameter of the snout extension piece 6.1 is therefore distinguished by a continuous tapering.

The outlet opening 6.15 or narrowest point of the snout extension piece 6.1 preferably has a clear internal width W of at most 120 mm, particularly preferably of at most 100 mm (cf. FIG. 4). Furthermore, the snout extension piece 6.1 is dimensioned in such a way that it ends at a spacing A in the range from 100 mm to 400 mm, preferably from 100 mm to 300 mm, with respect to the circumferential face of the deflecting roller 7. For example, the spacing A of the lower end of the snout extension piece 6.1 from the circumferential face of the deflecting roller 7 is approximately 200 mm.

As is known per se, the deflecting roller 7 is assigned a stabilizing roller 8, in order to ensure a flat, oscillation-free passage of the strip 1 through the flat snouts 5 of the jet stripping apparatus which are arranged above the dip bath. The carrying arms of the deflecting roller 7 and the stabilizing roller 8 are denoted by 7.1 and 8.1 in FIG. 1. Furthermore, the stabilizing roller 8 can be combined with a guide or pressure roller 9 which is likewise arranged in a dipped manner (cf. FIG. 2).

In the exemplary embodiments of the apparatus according to the invention which are shown in FIGS. 1 and 2, the connector section 6.11 of the snout extension piece 6.1 and the snout 6 define at least one feed channel 6.18, via which coating material B and/or at least one alloying additive LZ can be added in a separate manner into the dipped section of the snout 6 and/or into the snout extension piece 6.1.

Figure 5:
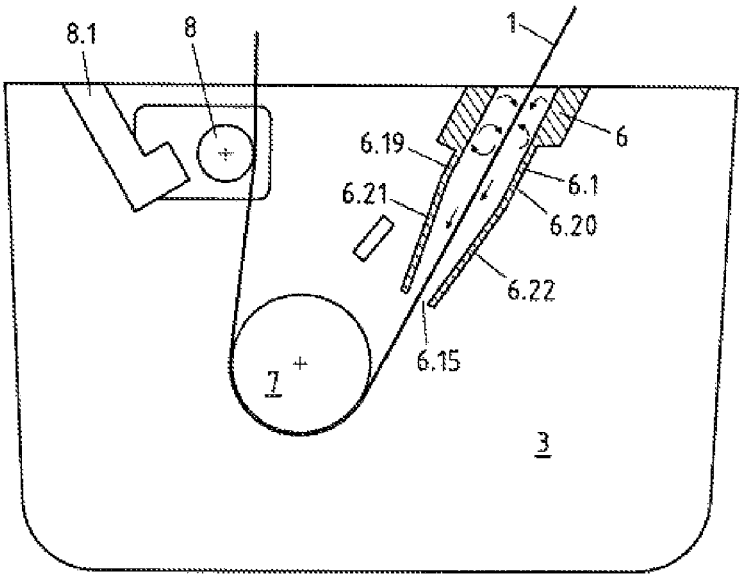
FIG. 5 shows a vertical sectional view of a further dip bath having a snout extension according to the invention, in which sectional view flow conditions are illustrated.

In the exemplary embodiment which is shown in FIG. 5, the snout extension piece 6.1 does not have a trough-shaped or tub-shaped connector section. Here, the snout extension piece 6.1 is attached directly at the end of the snout 6, that is to say no feed gap or feed channel is provided between the dipped end of the snout 6 and the snout extension piece 6.1. The snout extension piece 6.1 is composed of a plurality of walls or wall sections 6.19, 6.20, 6.21, 6.22 which face the upper side and underside of the strip 1. Whereas the upper walls/wall sections 6.19, 6.20 run substantially parallel to one another, the lower walls/wall sections 6.21, 6.22 are angled away from upper walls/wall sections 6.19, 6.20 and converge in the direction of the outlet opening 6.15. The constant internal diameter tapering of the snout extension piece 6.1 therefore extends over a part length of the snout extension piece in this exemplary embodiment.

Figure 6:
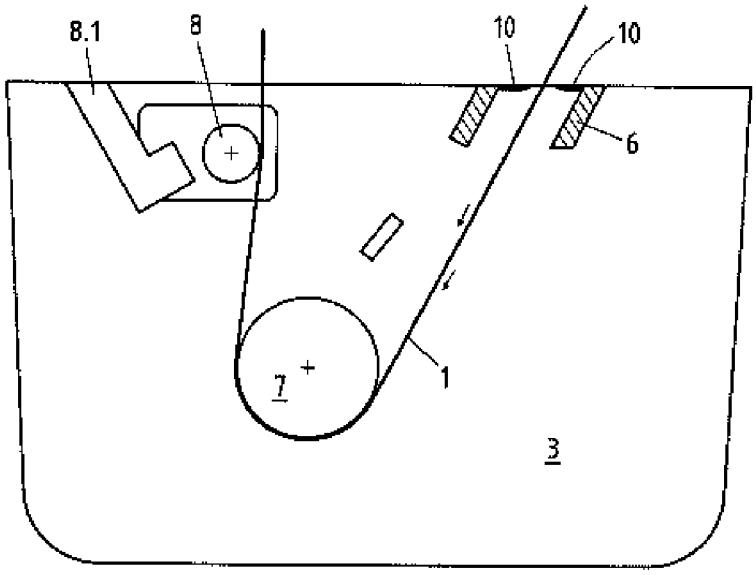
Fig.6 Prior art
FIG. 6 shows a dip bath of an apparatus for hot dip coating metal strip from the prior art.
Figure 7:
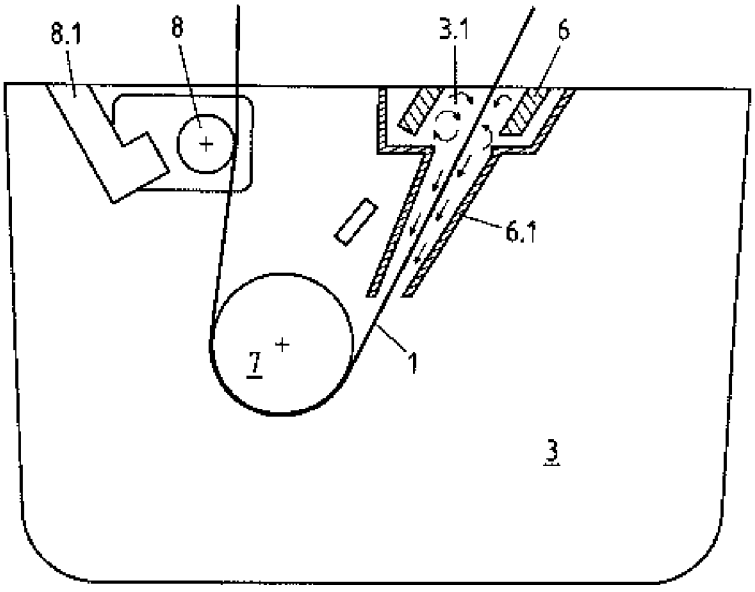
FIG. 7 shows a dip bath of an apparatus according to the invention for hot dip coating metal strip.

FIGS. 6 and 7 outline the speed distribution of the molten metal flow which is set in the dip bath vessel during operation of a coating apparatus from the prior art (FIG. 6) and during operation of a coating apparatus according to the invention (FIG. 7). A comparison of FIGS. 6 and 7 makes it clear that the flow in the snout 6, in particular in that region 3.1 of the dip bath surface level which is enclosed by the snout 6, is intensified by way of the snout extension 6.1 according to the invention, which brings about a constant exchange of the molten metal at the dip bath surface in the snout 6. In other words, circulation of the molten metal within the snout 6, in particular at the dip bath surface in the snout 6, is brought about by way of the snout extension 6.1 according to the invention. Therefore, no slag which causes surface defects in the coating of the strip 1 can accumulate in that region 3.1 of the dip bath surface level which is enclosed by the snout 6.

Figure 8:
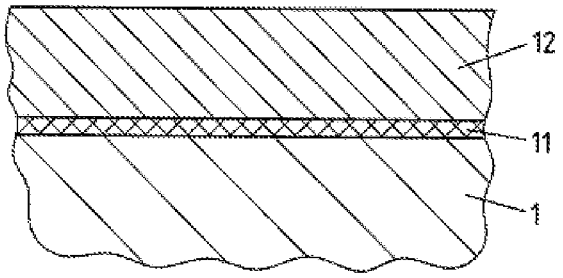
FIG. 8 shows a cross-sectional view of a section of a steel strip which is coated by way of dipping in an AlFeSi melt.

In addition, the snout extension according to the invention affords the possibility of providing regions with different molten metal compositions in the dip bath 3, in order to set defined desired alloy layer properties. This will be explained in greater detail in the following text with reference to FIGS. 8 to 10.

In conventional dip bath coating of steel strip with an aluminum melt which contains approximately 10% by weight of silicon, a relatively thin alloy layer 11 is produced at the steel/coating metal interface. The thickness of the alloy layer 11 is, for example, approximately 4 μm. The alloy layer 11 is followed by the top layer 12 of aluminum lying above it and embedded ferrosilicon needles. This coating which is known by the commercial name FAL Type 1 is sufficiently ductile on account of the thin alloy layer 11, in order for it to be possible to satisfactorily realize desired shaping operations of the coated steel strip 1 or steel plate. The anti-corrosion protection which is achieved by way of said coating, however, is not as satisfactory as in the case of a pure aluminum coating having the commercial name FAL Type 2.

Figure 9:
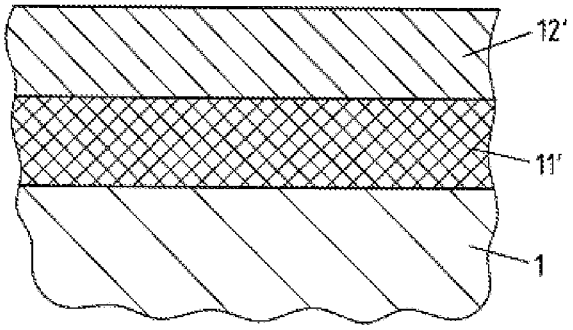
FIG. 9 shows a cross-sectional view of a section of a steel strip which is coated by way of dipping in a pure aluminum melt.
Figure 10:
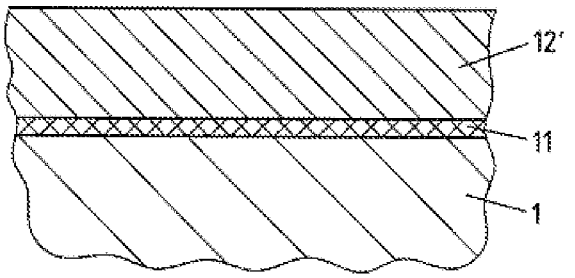
FIG. 10 shows a cross-sectional view of a section of a metal strip which is coated by way of dipping into two different metallic melts.
Figure 11:
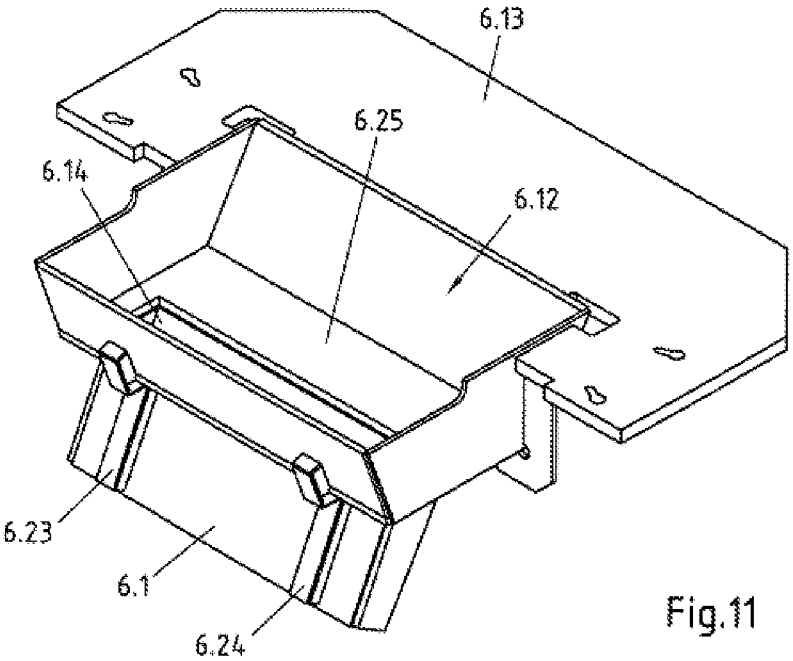
FIGS. 11 to 13 show a further exemplary embodiment of a snout extension piece in a perspective illustration, in a front view and in a plan view.
Figure 12:
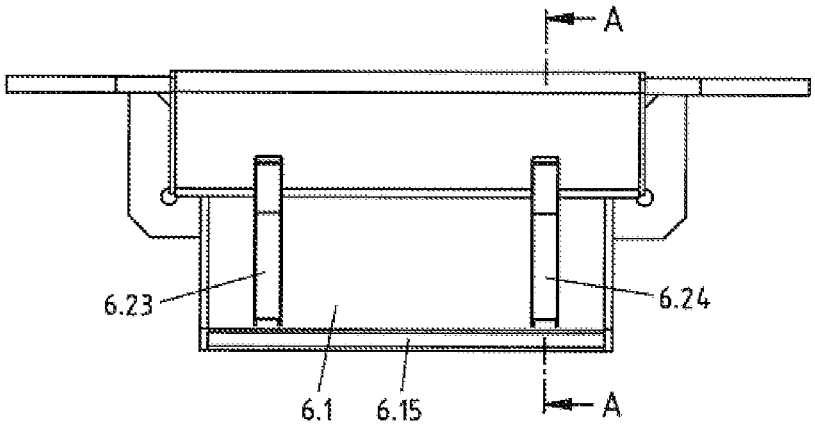
Figure 13:
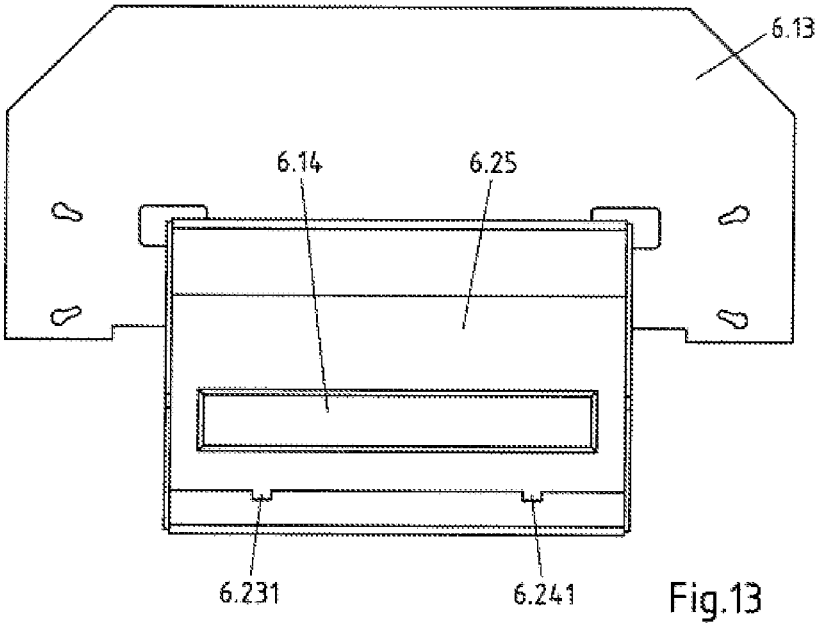
Figure 14:
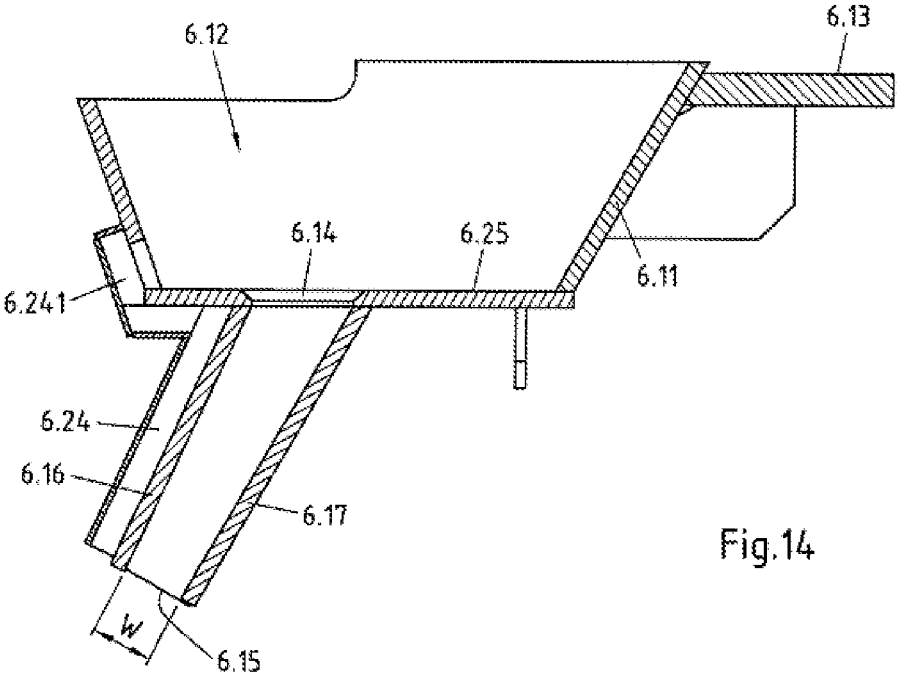
FIG. 14 shows a vertical sectional view of the snout extension piece along the sectional line A-A in FIG. 12.

FIG. 9 shows a section of a steel strip 1 which is coated by way of dipping in a pure aluminum melt, in cross section. This coat represents an excellent anti-corrosion protection means. 12' denotes the top layer of pure aluminum. On account of the absence of silicon in the molten metal, a relatively thick alloy layer 11' is formed at the steel/coating metal interface. In this case, the thickness of the brittle alloy layer 11' can be, for example, up to 20 μm. During shaping of the coated steel strip 1 or steel plate, the brittle alloy layer 11' is subject to crack formation and to detaching of the metal coat. On account of the restricted ductility, said product (FAL Type 2) is suitable only for simple components which do not require any relatively great shaping operations.

The apparatus according to the invention which is shown in FIG. 1 or FIG. 2 and in which the snout 6 and the connector section 6.11 of the snout extension piece 6.1 define at least one feed channel 6.18 makes it possible to enrich a silicon-containing molten metal in the snout 6, which molten metal leads to a thin alloy layer 11 in a similar manner to the alloy layer of the FAL Type 1 product. For example, an AlFeSi coating material can be added to the snout 6 via the tub-shaped connector section 6.11 of the snout extension piece 6.1 and the feed channel 6.18. In the actual dip bath vessel 4, in contrast, operation is carried out with a pure aluminum melt, with the result that a top layer 12' of pure aluminum is obtained. This product ("FAL Type 3") combines the advantages of the FAL Type 1 and FAL Type 2 products. This is because a product is obtained in this way which is sufficiently ductile as a result of the thin alloy layer 11, in order for it to be possible to realize desired relatively great forming operations, and which additionally has excellent anti-corrosion properties as a result of the top layer 12' of pure aluminum.

FIGS. 11 to 14 show a further exemplary embodiment of a snout extension piece according to the invention. As in FIGS. 1, 2 and 4, the snout extension piece 6.1 has a connector section 6.11, into which the lower end of the snout protrudes. The connector section 6.11 defines a tub-shaped or trough-shaped receiving space 6.12, the circumferential side wall of which is fastened to a carrier 6.13 which is mounted on the upper edge of the dip bath vessel.

An elongate opening 6.14 is configured in the bottom 6.25 of the connector section 6.11 or receiving space 6.12, through which opening 6.14 the metal strip to be coated runs into the shaft-shaped snout extension piece 6.1. The internal width (clear internal height) W of the snout extension piece 6.1 tapers toward its outlet opening 6.15. The tapering of the internal width W results from the fact that the walls 6.16, 6.17 of the snout extension piece 6.1 which face the upper side and underside of the strip 1 converge in the direction of the outlet opening 6.15. The front wall 6.16 encloses an acute angle with the bottom 6.25, which acute angle is, for example, approximately 65°. The rear wall 6.17 encloses an acute angle with the bottom 6.25, which acute angle is, for example, approximately 60° (cf. FIG. 14).

The outlet opening 6.15 or narrowest point of the snout extension piece 6.1 has a clear internal width W of, for example, less than 130 mm, preferably at most 120 mm, particularly preferably at most 100 mm. Furthermore, the snout extension piece 6.1 is dimensioned in such a way that the snout dipping depth is at least 400 mm, preferably at least 500 mm, particularly preferably at least 600 mm, during hot dip coating of the metal strip.

The snout extension piece 6.1 is provided with separate channels 6.23, 6.24, through which molten metal can flow out of the dip bath vessel 4 in the direction of the dip bath surface level in the snout or receiving space 6.12 in the case of lowering of the dip bath level in the snout with respect to the dip bath level (dip bath surface level) outside the snout 6.

The separate channels 6.23, 6.24 are preferably arranged on the outer side of the front wall 6.16 of the snout extension piece 6.1. The respective channel 6.23, 6.24 can consist of a tube or can be formed from a U-profile, the limbs of which are connected, for example welded, to the wall of the snout extension piece 6.1. As an alternative or in addition, corresponding channels can be arranged on the outer side of the rear wall 6.17 and/or on the narrower side walls of the snout extension piece 6.1. The channels 6.23, 6.24 open above the bottom 6.25 of the connector section 6.11. To this end, the upper end sections 6.231, 6.241 of the channels 6.23, 6.24 are arranged on the outer side of that front wall of the connector section 6.11 which faces that section of the strip 1 which runs out of the dip bath vessel 4 during operation. The upper end sections 6.231, 6.241 of the channels 6.23, 6.24 merge into channel sections which are arranged on the underside of the bottom 6.25 (cf. FIG. 14). The upper outlet openings of the channels 6.23, 6.24 are therefore situated above the bottom 6.25 in a throat region which is defined by the bottom 6.25 and the front wall of the connector section 6.11.

The implementation of the invention is not restricted to the exemplary embodiments which are shown in the drawing. Rather, a plurality of variants are conceivable which, even in the case of a differing design, make use of the invention which is specified in the appended claims. It therefore also lies within the scope of the invention, for example, if the internal width of the dipped snout extension piece 6.1 tapers toward its outlet opening 6.15 at least over a part length of said snout extension piece 6.1 in a stepped manner in the form of one or more internal width steps and/or in the form of snout wall sections which are angled away differently with respect to one another.

The invention claimed is:

1. An apparatus for hot dip coating a metal strip, comprising a dip bath vessel including molten metal providing a dip bath surface, a snout which opens into the dip bath vessel for introducing the metal strip into said dip bath vessel, said hot dip coating metal strip is heated in a continuous furnace before being introduced into the dip bath vessel, and a deflecting roller which is arranged in the dip bath vessel for deflecting the metal strip in a direction which points out of the dip bath vessel, wherein the snout is provided with a snout extension piece for increasing a snout dipping depth, an internal width of the snout extension piece tapering toward an outlet opening at least over a part length of the snout extension piece, said snout extension piece is shaft-shaped, wherein the snout extension piece has a connector section, a lower end of the snout protrudes into the connector section beneath the dip bath surface, said connector section includes a receiving space located beneath the dip bath surface and said receiving space is located beneath the lower end of the snout and above the snout extension piece, and wherein at least one feed channel is defined between the lower end of the snout and the snout extension piece for the separate addition of coating material or at least one alloying additive into the snout and/or into the snout extension piece.

2. The apparatus as claimed in claim 1, wherein the internal width of the snout extension piece tapers constantly toward the outlet opening at least over a part length of said snout extension piece.

3. The apparatus as claimed in claim 1, wherein the internal width of the snout extension piece tapers toward the outlet opening at least over a part length of the snout extension piece in a stepped manner in the form of one or more internal width steps and/or in the form of snout wall sections which are angled away differently with respect to one another.

4. The apparatus as claimed in claim 1, wherein the outlet opening or a narrowest point of the snout extension piece has a clear internal width of at most 120 mm.

5. The apparatus as claimed in claim 1, wherein the snout extension piece ends at a spacing in a range from 100 mm to 400 mm with respect to a circumferential face of the deflecting roller.

6. The apparatus as claimed in claim 1, wherein a length of the snout extension piece is dimensioned in such a way that the snout dipping depth is at least 400 mm during the hot dip coating of the metal strip.

7. The apparatus as claimed in claim 1, wherein the snout extension piece is provided with at least one separate channel, through which molten metal can flow out of the dip bath vessel in a direction of a molten metal surface in the snout in case of negative pressure in the snout or in case of lowering of the molten metal surface in the snout with respect to a molten metal surface outside the snout.

8. The apparatus as claimed in claim 7, wherein the at least one separate channel is arranged on an outer side of the snout extension piece.

9. The apparatus as claimed in claim 7, wherein the at least one separate channel opens at a lower end of the snout extension piece.

10. The apparatus as claimed in claim 7, wherein the at least one separate channel has an end section which opens above a bottom of the connector section in a throat region thereof.

11. The apparatus as claimed in claim 4, wherein the clear internal width is at most 100 mm.

12. The apparatus as claimed in claim 5, wherein the spacing is in the range from 100 mm to 300 mm.

13. The apparatus as claimed in claim 1, wherein a length of the snout extension piece is dimensioned in such a way that the snout dipping depth is at least 500 mm during the hot dip coating of the metal strip.

14. The apparatus as claimed in claim 1, wherein a length of the snout extension piece is dimensioned in such a way that the snout dipping depth is at least 600 mm during the hot dip coating of the metal strip.

* * * * *